US005092766A

United States Patent [19]

Kubotani

[11] Patent Number: 5,092,766

[45] Date of Patent: Mar. 3, 1992

[54] PULSE COMBUSTION METHOD AND PULSE COMBUSTOR

[75] Inventor: Atsuyoshi Kubotani, Amagasaki, Japan

[73] Assignee: Osaka Fuji Kogyo Kabushiki Kaisha, Japan

[21] Appl. No.: 627,959

[22] Filed: Dec. 17, 1990

[30] Foreign Application Priority Data

Dec. 16, 1989 [JP] Japan ..... 1-326861

[51] Int. Cl.[5] ..... F27D 7/00

[52] U.S. Cl. ..... 432/25; 432/58; 34/57 R; 431/1

[58] Field of Search ..... 431/1, 25; 122/24; 60/39.77; 432/58; 34/57 R, 130

[56] References Cited

U.S. PATENT DOCUMENTS 4,750,452 6/1988 Trihey ..... 431/1
4,770,626 9/1988 Zinn et al. ..... 431/1

FOREIGN PATENT DOCUMENTS 1455130 1/1989 U.S.S.R. ..... 431/1

*Primary Examiner*—Henry A. Bennet
*Attorney, Agent, or Firm*—Cushman, Darby & Cushman

[57] ABSTRACT

It is an object of the present invention to provide a pulse combustion method and a valveless pulse combustor in which the strong sound wave energy and the combustion gas generated by explosions in the combustion chamber are effectively used for drying of a substance with no waste of sound wave energy and heat of the combustion gas.

A pulse combustion method according to the present invention is characterized by a step of pushing the sound wave energy and the combustion gas which flow toward the air intake back to the combustion chamber by jetting a compressed gas toward the air intake. By means of this step, the sound wave energy and the combustion gas which were generated at the time of explosion in the combustion chamber and flow toward the air intake are pushed back to the combustion chamber and further to the exhaust pipe by a stream of the compressed gas. This enables the sound wave energy and the combustion gas which have been conventionally wasted to be used for drying of a substance.

9 Claims, 4 Drawing Sheets

PULSE COMBUSTION METHOD AND PULSE COMBUSTOR

FIELD OF THE INVENTION

The present invention relates to a pulse combustion method and a pulse combustor to obtain a dried substance from a substance in a state of a paste or a slurry by eliminating liquid components from the substance.

DESCRIPTION OF THE PRIOR ART

A novel pulse combustor is disclosed in Japanese Patent Laid-Open Publication No. 60-238677. The pulse combustor comprises a combustion chamber, an air intake with an open end and an exhaust pipe which are arranged in line with the combustion chamber in the middle so that they have a common axis. In this combustor, most of a strong sound wave energy and a high temperature combustion gas which are generated by explosions in the combustion chamber flow to the exhaust pipe to be used for drying a substance. However, the rest of the sound wave energy and the combustion gas flow toward the air intake, and the sound U wave energy and the high temperature gas are not used for drying the substance, resulting a waste of sound wave energy and heat.

SUMMARY OF THE INVENTION

It is, therefore, an object of the present invention to provide a pulse combustion method and a pulse combustor in which the strong sound wave energy and the combustion gas generated by explosions in the combustion chamber are effectively used for drying of a substance with no waste of sound wave energy and heat.

DETAILED DESCRIPTION OF THE PREFERRED EMBODIMENTS

Figure 1:
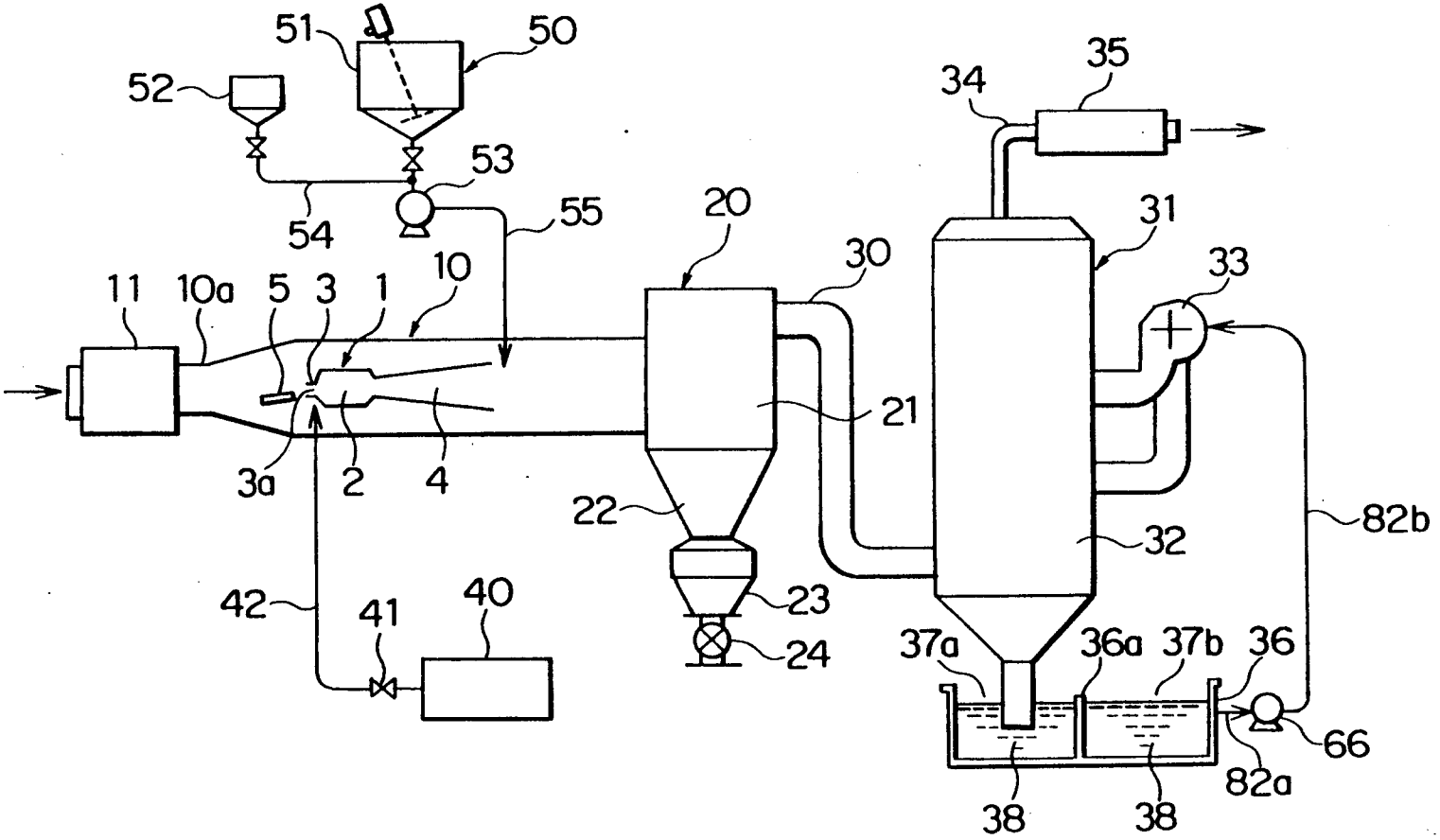
FIG. 1 is a schematic view of a pulse combustion drying apparatus provided with a pulse combustor according to the present invention.

In a pulse combustion method according to the Q present invention using a pulse combustor comprising a combustion chamber, an air intake with an open end, an exhaust pipe which are arranged in line with the combustion chamber in the middle, a fuel port and an ignition means, the improvement is that said method comprises a step of pushing the sound wave energy and the combustion gas which flow toward the air intake back to the combustion chamber by jetting a stream of compressed gas toward the open end of the air intake. By means of this step, a part of the sound wave energy and the combustion gas which were generated at the time of explosion in the combustion chamber and flow toward the air intake are pushed back to the combustion chamber and further to the exhaust pipe by the stream of the compressed gas. This enables the sound wave energy and the combustion gas which have been conventionally wasted to be used for drying of a substance.

And, in a pulse combustor according to the present invention comprising a combustion chamber, an air intake with an open end, an exhaust pipe which are arranged in line with the combustion chamber in the middle, a fuel port and an ignition means, the improvement is that said combustor comprises a compressed gas supplying means disposed at a position opposing to the open end of the air intake so that a stream of compressed gas jetted from the compressed gas supplying means is blown into the combustion chamber through the open end of the air intake.

An embodiment of the above-mentioned pulse combustor is that said compressed gas supplying means is disposed diagonally so that a stream of compressed gas jetted from the compressed gas supplying means is blown into the combustion chamber through the open end of the air intake at a specified angle. Because the stream of compressed gas is discharged from the compressed gas supplying means at a specified angle, the open end of the air intake is partly covered with the stream of compressed gas, and thereby the sound wave energy and the combustion gas which flow toward the air intake are partly pushed back to the combustion chamber and further to the exhaust pipe. The stream of compressed gas comes into the combustion chamber and stirs the fuel filled therein, whereby the density of fuel in the combustion chamber becomes uniform.

Another embodiment of the above-mentioned pulse combustor is that said compressed gas supplying means is disposed in front of the open end of the air intake so that the open end of the air intake is covered with a stream of compressed gas jetted from the compressed gas supplying means completely. Because the open end of the air intake is covered with the stream of compressed gas completely, all the sound wave energy and the combustion gas which flow toward the air intake are pushed back to the combustion chamber and further to the exhaust pipe by the stream of compressed gas.

A further embodiment of the above-mentioned pulse combustor is that in a pulse combustor comprising a combustion chamber, an air intake with an open end, an exhaust pipe which are arranged in line with the combustion chamber in the middle, a fuel port and an ignition means, the improvement is that said combustor comprises a compressed gas supplying means disposed at a position opposing to the open end of the air intake so that a stream of compressed gas jetted from the compressed gas supplying means is blown into the combustion chamber through the open end of the air intake, and a heat insulating cover enclosing the pulse combustor so as to form an annular space between them, in which the compressed gas supplying means is arranged so that a part of the stream of compressed gas jetted from the compressed gas supplying means is blown into one end of the space and is discharged from the downstream end of the space. The stream of compressed gas takes heat from the outer wall of the pulse combustor and lowers the temperature of the wall of the pulse combustor while flowing in the space. On the other hand, the temperature of the compressed gas rises.

In an embodiment of this type pulse combustor, the downstream end of the space is open straight so that the compressed gas discharged from the space flows in the same direction as the combustion gas discharged through the exhaust pipe of the pulse combustor. The discharged air lowers the dew point of gas in the area where substances are dried.

In another embodiment of this type pulse combustor, the downstream end of the space is provided with a baffleplate for diverting the stream of the compressed gas at the periphery of the open end of the exhaust pipe and a band-shaped gap is provided around the heat insulating cover so that the compressed gas discharged from the gap flows in a direction perpendicular to the axis of the pulse combustor. The perpendicular stream of compressed gas divides in two the inside of a dryer in which the pulse combustor is incorporated at an imaginary plane including the open end of the exhaust pipe. The stream of compressed gas lowers the temperature of the outer wall of the pulse combustor while flowing in the space, and the perpendicular stream of compressed gas discharged from the gap prevents substance which is conveyed to the downstream side of the exhaust pipe from sticking on the outer wall of the heat insulating cover of the pulse combustor.

In a further embodiment of this type pulse combustor, the downstream end of the space is closed and a nozzle slanting downward to the downstream direction is connected at the lower part of the downstream end of the space. The nozzle acts as a deposit removing means. When the compressed gas is discharged through the nozzle, it blows substance deposited in the dryer, in which the pulse combustor is incorporated, and further ejects the substance from the dryer.

In a still further embodiment of this type .pulse combustor, the downstream end of the space is closed and a pipe is connected to the downstream end of the space to lead to a spiral tube which is provided along the wall of a dryer, in which the pulse combustor is incorporated. The spiral tube can be a one in which neighboring tubes are adhered each other and forms a part of the wall of the dryer. The high temperature stream of compressed gas flowing in the spiral tube thermally shields the wall of the dryer from environmental air in order to maintain the temperature in the dryer.

The description of an exemplary pulse combustion method and pulse combustors is given to embody the principles and the features of the present invention with reference to the accompanying drawings, in which FIG. 1 is a schematic view of a pulse combustion drying apparatus provided with a pulse combustor; and FIGS. 2, 3, 4, 5, 6 and 7 are vertical sectional view of exemplary pulse combustors.

In an embodiment mentioned in FIG. 1, compressed air is used as the compressed gas. The pulse combustion drying apparatus comprises a pulse combustor 1, a dryer 10 disposed on the same axis as the pulse combustor 1 and enclosing the pulse combustor 1, a product collector 20 attached to the downstream site of the dryer 10, a scrubber 31 connected to the product collector 20 through a duct 30, a fuel supply device 40 and a substance supply device 50.

The pulse combustor 1 is so made that a cross section thereof is a circle. The body of the pulse combustor 1 comprises a combustion chamber 2, an air intake 3 and an exhaust pipe 4, and the pulse combustor 1 also has compressed air supplying means 5. The combustion chamber 2 is constructed in the middle, and at the both sides, the air intake 3 and the exhaust pipe 4 are disposed. The combustion chamber 2, the air intake 3 and the exhaust pipe 4 have a common axis. The compressed air supplying means 5 is disposed at the upstream side of the air intake 3 and opposes to the open end 3*a* of the air intake 3.

The dryer 10 is cylindrical, and inside the dryer 10 the pulse combustor 1 is disposed on substantially the same axis as the dryer 10. The upstream side, that is, the intake side 10*a* of the dryer 10 is tapered at a dull angle and connected to a muffler 11. The downstream side, that is, the exhaust side 10*b*of the dryer 10 is connected to the product collector 20.

The product collector 20 comprises a vertical cylindrical part 21, a tapering part 22 which is tapered at a dull angle in the lower part of the collector 20, a collecting room 23 disposed under the tapering part 22 and an outlet 24 disposed at the bottom of the collecting room 23.

The duct 30 connects the collector 20 with the scrubber 31. The one end of the duct 30 is connected to an upper part of the cylindrical part 21 of the collector 20 at the opposite side of the connecting place of the cylindrical part 21 and the dryer 10, and the other end is connected to a lower part of the scrubber 31.

The scrubber 31 comprises a vertical cylindrical part 32, a fan part 33 fixed on the outer wall, a muffler 35 connected with the cylindrical part 32 through a pipe 34, a slurry tank 36 disposed below the cylindrical part 32 and a circulating water pump 66. The fan part 33 has a function of reducing the pressure in the scrubber 31 and further reducing the pressure in the whole drying apparatus. The circulating water pump 66 supplies water 38 deposited in the slurry tank 36 of the scrubber 31 for the upper cylindrical part 32 of the scrubber 31 again. A water pipe 82*a* connects the slurry tank 36 to the water inlet of the pump 66, and a water pipe 82*b* connects the water outlet of the pump 66 to the fan part 33 of the scrubber 31. U A fuel pipe 42, which has a valve 41, connects the fuel supply device 40 with the combustion chamber 2 of the combustor 1. The fuel pipe 42 pierces through the wall of the dryer 10 and leads to the combustion chamber 2. Natural gas, propane gas, oil or the like may be used as fuel.

The substance supply device 50 comprises a substance tank 51, a water tank 52 and a slurry pump 53. The substance tank 51 is connected to the slurry pump 53, and the water tank 52 is connected to the slurry pump 53 through a pipe 54. A substance supply pipe 55 extended from the slurry pump 53 pierces into the Q dryer 10, and the outlet is disposed at the downstream side of the exhaust pipe 4.

This apparatus may be used to dry waste liquid or slurry containing aluminum, calcium, iron oxide or the like, such food as yeast, etc. and such medicine as vitamins.

The operation of the pulse combustion drying apparatus with the composition above is described below.

When the pulse combustion drying apparatus is started, environmental air is took into the dryer 10 through the muffler 11, and a gas and dust remained in the dryer 10 are discharged outside, as the fan part 33 of the scrubber 31 operates. This prevents poor combustion.

A proper mixture of fuel and air is supplied for the combustion chamber 2 through the fuel pipe 42. Ignition means such as a ignition plug (not shown) generates a spark, and it causes an explosion of the mixture of fuel and air filled in the combustion chamber 2. Most of the high temperature combustion gas generated by the explosion flows to the exhaust pipe 4, but the rest of the gas flows to the air intake 3. The stream of compressed air supplied by the compressed air supplying means 5 pushes the combustion gas which flow to the air intake 3 back to the combustion chamber 2 and further to the exhaust pipe 4. Immediately after the explosion, the pressure in the combustion chamber 2 becomes higher, and the supply of the mixture of fuel and air is stopped temporarily. Thereafter, when the pressure in the combustion chamber 2 becomes lower, the intake of the mixture of fuel and air is resumed, and an explosion is caused again either by a spark generated by the ignition means or by the contact of the mixture of fuel and air with the sufficiently heated wall of the combustion chamber 2. This action is repeated successively. Once the temperature in the combustion chamber 2 reaches a certain degree, explosions occur automatically without the use of the ignition means. Thus, the pulse-like pressure fluctuation in the pulse combustor 1 generates strong sound wave energy, and the sound wave energy is mainly propagated from the combustion chamber 2 to the exhaust pipe 4. Also, a shock wave of gas with high temperature of about 1,400°-1,500° C. generated by the repeated explosions flows to the exhaust pipe 4.

A substance in a state of slurry or paste and to be dried by the drying apparatus is put into the substance tank 51. The substance is mixed with air and water depending on the case so that the drying procedure will be the most efficient, and the mixture is conveyed by the slurry pump 53 to the slightly downstream side of the exhaust pipe 4 of the pulse combustor 1 U through the supply pipe 55. The substance to be dried is divided into a solid component and a liquid component and both of them are crushed into pieces because of the effect of the strong sound wave to reduce viscosity and surface tension of the substance, though which effect has not been reported officially. The heat of the combustion gas acts efficiently to vaporize the liquid component whose surface area has been increased, and the most of the heat is spent for the vaporization of the liquid component. Meanwhile, the substance to be dried contacts with the combustion gas with high temperature of about 1,400°-1,500° C. only for an extremely short time of 0.005°-0.01 seconds. Thus, since the contact time of the substance with the high temperature combustion gas is extremely short and a large amount of heat is spent for the vaporization of the liquid component, the dried solid component has relatively low temperature (about 30°-60° C.) when it is discharged from the dryer 10 to the product collector 20.

Most of the solid component discharged to the product collector 20 is collected in the lower part of the collector 20 because of the gravity, and only a part of the solid component which is relatively light moves with the combustion gas to the scrubber 31 through the duct 30. The dried substance collected in the collector 20 are discharged from the pulse combustion drying apparatus through the outlet 24 disposed at the bottom of the collector 20.

The light solid component and the combustion gas are separated in the scrubber 31, and the solid component is eliminated. Only the gas is transported through the elbow pipe 34 and the muffler 35 and then discharged. The solid component is discharged to a precipitator 37*a* of the slurry tank 37 disposed at the bottom of the scrubber 31. The clean water in the precipitator 37*a* overflows to a clean water tank 37*b* disposed next to the precipitator 37*a*, and the water is supplied for the fan part 33 of the scrubber 31 again through a circulating water pump 66.

Figure 2:
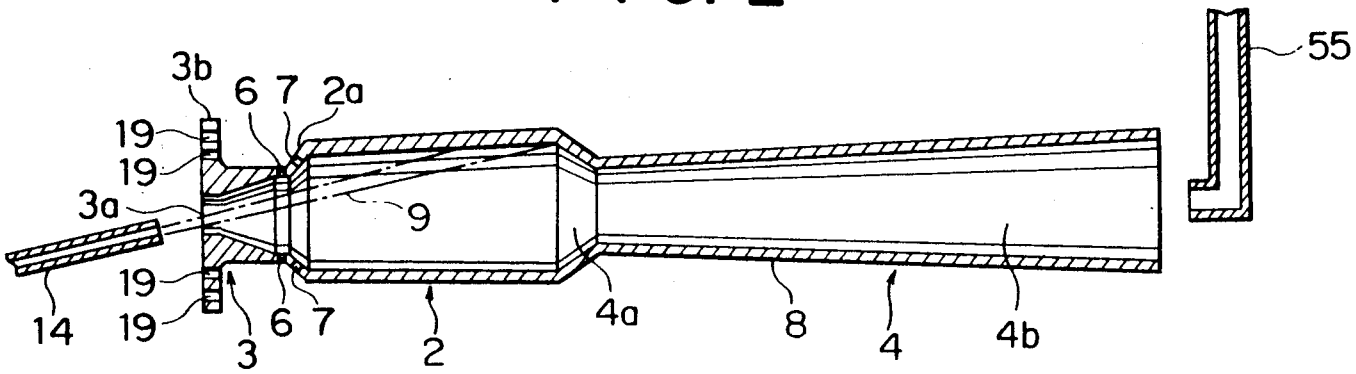
FIGS. 2, 3, 4, 5, 6 and 7 are vertical sectional views of exemplary pulse combustors embodying the principle and feature of the present invention.

Now referring to FIG. 2, there is shown a first exemplary pulse combustor according to the present invention.

The pulse combustor is so made that a cross section thereof is a circle, and it has a body comprising the combustion chamber 2, the air intake 3 and the exhaust pipe 4, and a pipe 14 acting as compressed air supplying means.

The air intake 3 is shaped like a circular cone and becomes wider gradually toward the combustion chamber 2. The exhaust pipe 4 is of Venturitube type, and it has an inflow port 4*a* tapering at a keen angle next to the combustion chamber 2 and an exhaust port 4*b* becoming wider gradually. A widening wall 2*a*, which becomes wider at a keen angle and is a part of the combustion chamber 2, is formed at the border between the air intake 3 and the combustion chamber 2. A plurality of fuel holes 7 incorporating fuel nozzles (not shown) for supplying a mixture of fuel and air for the combustion chamber 2 are made in the wall 2*a*. The fuel is supplied by the fuel supply device 40 through the fuel pipe 42 via the valve 41 (shown in FIG. 1) and taken into the combustion chamber 2 through the fuel holes 7.

At the downstream side of the air intake 3, that is, in the wall of the air intake 3 near the combustion chamber 2, a plurality of ignition holes 6 incorporating ignition means such as ignition plugs (not shown) are made. Slightly away from the open end 3*a* of the air intake 3, the pipe 14 is disposed on a slant, and the outlet opposes to the open end 3*a* of the air intake. The pipe 14 jets compressed air to push the combustion gas which was generated at the time of explosion in the combustion chamber 2 and flow to the air intake 3 back to the combustion chamber 2 and further to the exhaust pipe 4. Ordinarily, compressed air with a pressure of 0.1.8 $kg/cm^2$ is used. As the heat generated by the explosion causes a high temperature at the outer wall of the pulse combustor 1, it is necessary to lower the temperature of the outer wall for a long life of the pulse combustor 1. Hence, many fins 8 are disposed around the pulse combustor 1 in order to increase heat dissipation from the outer wall of the combustion chamber 2, the air intake 3 and the exhaust pipe 4. Further, a baffleplate 3*b* is disposed at the open end of the air intake 3, and a plurality of holes 19 are formed on the baffleplate 3*b*, which are used for fixing this pulse combustor 1 on a support (not shown) disposed in the dryer 10 via a bolt.

The operation of the pulse combustor with the composition above is described below. The stream of compressed air 9 discharged from the pipe 14 at a certain angle is blown into the pulse combustor through the open end 3*a* of the air intake 3 and reaches the inner wall of the combustion chamber 2. Thereby, the of compressed air, and the fuel which was supplied through the holes 7 and filled in the combustion chamber 2 is stirred, which makes the fuel very explosive. When the fuel in this state is ignited by the ignition means such as ignition plugs, an explosion occurs in the combustion chamber 2, and a strong sound wave energy and a high combustion gas are generated. Most of them flow to the exhaust pipe 4 to dry a substance to be dried which is supplied through the substance supply pipe 55.

Meanwhile, the rest of the sound wave energy and the combustion gas flow toward the air intake 3. However, the stream of compressed air 9 ejected from the pipe 14 pushes a part of the sound wave energy and the combustion gas which flows toward the air intake 3 back to the combustion chamber 2 and further to the exhaust pipe 4. Also, since the stream of compressed air 9 stirs the fuel in the combustion chamber 2, the density of fuel in the combustion chamber 2 becomes uniform, which enables stable explosions and further increases the combustion efficiency.

Figure 3:
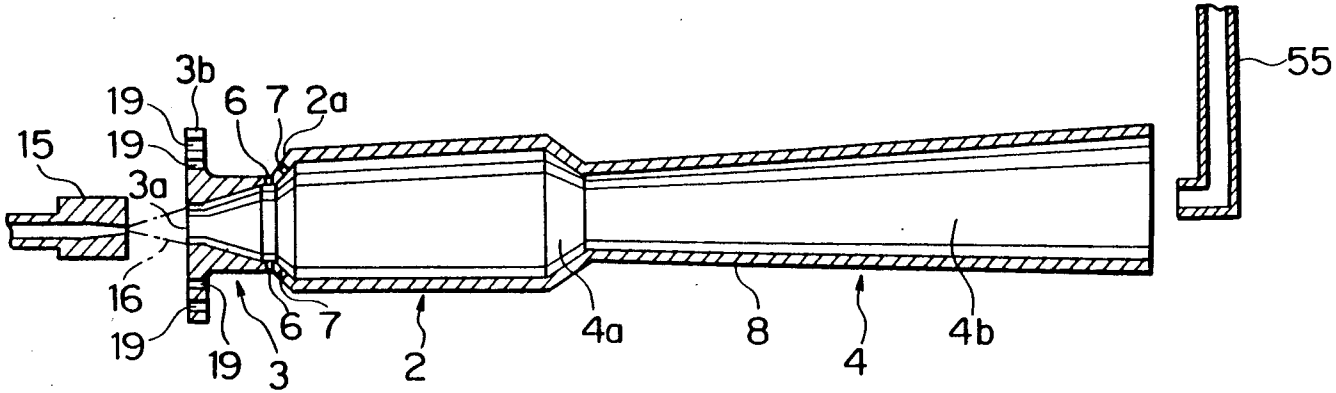

FIG. 3 is a vertical sectional view of a second exemplary pulse combustor according to the present invention.

A nozzle 15 acting as compressed air supplying means is disposed opposing to and in front of the open end 3*a* of the air intake 3. A stream of compressed air 16 radiates from the nozzle 15, and the end 3*a* of the air intake 3 is covered with the stream of compressed air completely. The pressure of the compressed air 16 is ordinarily 0.1.8 kg/cm$^2$. All the strong sound wave energy and the high temperature combustion gas which flows toward the air intake 3 are pushed back to the combustion chamber 2 and further to the exhaust pipe 4 by the stream of compressed air 16. In the first exemplary pulse combustor, the sound wave energy and the combustion gas still leak from the open end 3*a* of the air intake 3 because the end 3*a* is not covered completely. In this second exemplary pulse combustor, however, the stream of compressed air 16, which covers the ends 3*a* completely, pushes all the sound wave energy and the combustion gas back to the combustion chamber 2, and thereby the energy efficiency is increased.

Figure 4:
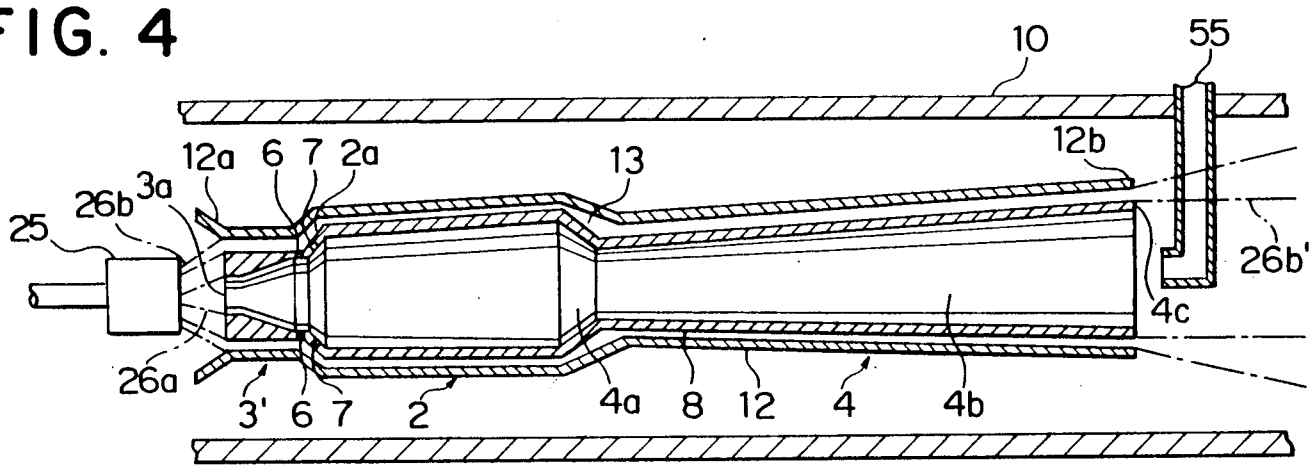

FIG. 4 is a vertical sectional view of a third exemplary pulse combustor according to the present invention.

The air intake 3, of the pulse combustor does not have a baffleplate like the baffleplate 3*b* shown in FIGS. 2 and 3. The body of the pulse combustor is supported by a support (not shown) disposed on the inner wall of the dryer 10 so that the pulse combustor is set on the axis of the dryer 10. Also, the body of the pulse combustor and a heat insulating cover 12 may be made integrally, and the heat insulating cover 12 may be supported by a support (not shown) disposed on the inner wall of the dryer 10. The body of the pulse combustor is enclosed with the heat insulating cover 12, and space 13 is formed between the pulse combustor and the heat insulating cover 12. This heat insulating cover 12 is set in the dryer 10 supported by a support (not shown) disposed on the inner wall of the dryer 10. The both ends of the space 13 are open respectively with an annular gap between the heat insulating cover 12 and the pulse combustor.

A double hole nozzle 25 acting as compressed air supplying means is so disposed that the holes oppose the open end 3*a* of the air intake 3'. The stream of compressed air 26*a* radiates from the center hole of the nozzle 25 and covers the open end 3*a* of the air intake 3' completely. Further, the stream of compressed air 26*b* radiates from the peripheral hole, enclosing the stream of compressed air 26*a*, and the stream of compressed air 26*b* is blown into the space 13 between the outer wall of the pulse combustor and the heat insulating cover 12. The heat insulating cover 12 has a receiving portion 12*a* at the upstream end to make U it easy to guide the stream of compressed air 26*b* into the space 13.

The operation of the pulse combustor with the above. described composition is described below.

The stream of compressed air 26*a* discharged from the double hole nozzle 25 pushes the strong sound wave energy and the combustion gas which flow toward the air intake 3' back to the combustion chamber 2 and further to the exhaust pipe 4. The outer wall of the pulse combustor has reached a high temperature of about 500°-800 ° C. because of successive explosions in the combustion chamber 2. While the stream of compressed air 26*b* discharged from the nozzle 25 is flowing in the space 13 between the outer wall of the pulse combustor and the heat insulating cover 12, the stream of compressed air 26*b* takes heat from the outer wall of the pulse combustor and thereby lowers the temperature of the outer wall of the pulse combustor. This contributes to a long life of the pulse combustor. Then, the stream of compressed air which got heat from the body of the pulse combustor and has reached a high temperature is discharged through a space between the downstream end 12*b* of the cover 12 and the downstream end 4*c* of the exhaust pipe 4. The dried high temperature stream of compressed air 26*b*, lowers the dew point in the downstream area of the dryer 10, that is, the area where substances supplied through the pipe 55 are dried, and thereby increasing the drying efficiency.

Figure 5:
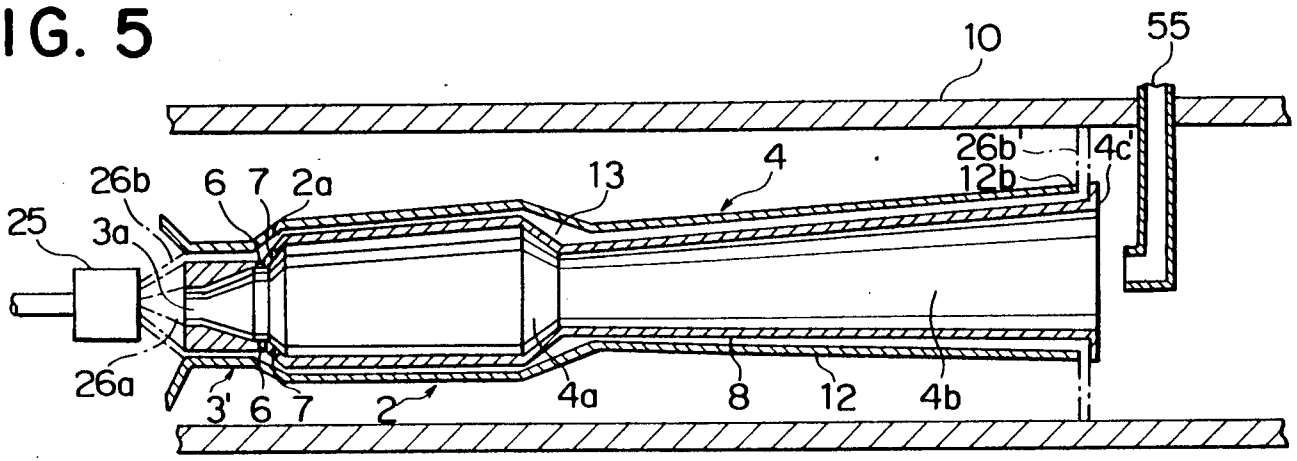

FIG. 5 is a vertical sectional view of a fourth exemplary pulse combustor according to the present invention.

A baffleplate 4*c'* for diverting the stream of the compressed air 26*b* is disposed at the end of the space 13, that is, at the periphery of the end of the exhaust pipe 4, and a band-shaped gap is provided around the heat insulating cover. The stream of compressed air 26*b'* is discharged through the gap between the downstream end 12*b* of the heat insulating cover 12 and the baffleplate 4*c'* in a direction perpendicular to the axis of the exhaust pipe. The thus discharged stream of compressed air 26*b'* reaches the inner wall of the dryer 10, and the stream of compressed air 26*b'* functions as an air curtain dividing the inside of the dryer 10 in two at an imaginary vertical plane including the end of the exhaust pipe 4. In the pulse combustor with the above-described composition, not only does the stream of compressed air 26*b* lower the temperature of the outer wall of the pulse combustor, but also the air curtain of the stream of compressed air 26*b'* prevents substances supplied through the pipe 55 from sticking on the outer wall of the pulse combustor and the surface of the heat insulating cover 12. This pulse combustor is very effective especially when iron oxide is to be dried.

Figure 6:
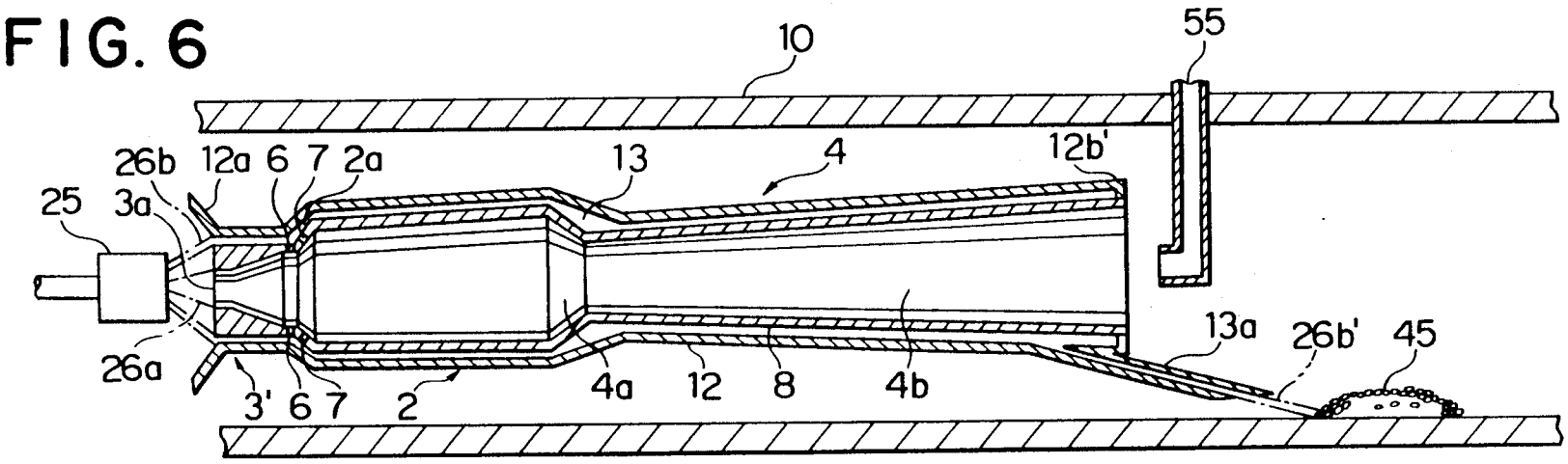

FIG. 6 is a vertical sectional view of a fifth exemplary pulse combustor according to the present invention. There are some cases where a part of dried substance is deposited inside of the dryer 10 depending on the kind of the substance. This embodiment shows a pulse combustor which is capable of eliminating the deposited substance.

The downstream end of the space 13 is closed and a deposit blowing nozzle 13*a* slanting downward to the downstream direction is connected at the lower part of the downstream end of the space 13 and down to the neighborhood of the lower inner wall of the dryer 10. The downstream end 12*b'* of the heat insulating cover 12 is jointed with the downstream edge of the outer wall of the exhaust pipe 4 and closes the end of the space 13. The stream of compressed air 26*b'* which got heat while flowing in the space 13 is discharged from the nozzle 13*a*, and the high temperature stream of compressed air 26*b'* blows substances 45 deposited in the dryer 10 downstream and further discharges the substances from the dryer 10. Also, in this pulse combustor, the stream of compressed air 26*b* functions to lower the temperature of the outer wall of the pulse combustor.

Figure 7:
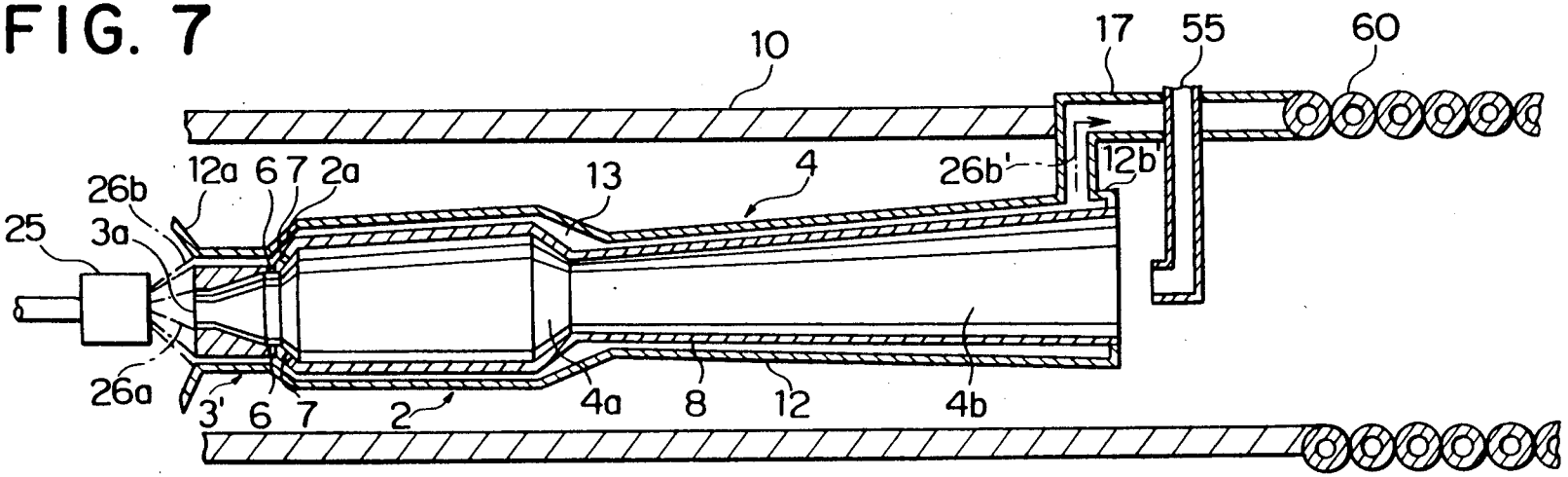

FIG. 7 is a vertical sectional view of a sixth exemplary pulse combustor according to the present invention.

The downstream end of the space 13 is closed and a pipe 17 is connected to the downstream end of the space 13 to lead to a spiral tube 60 which is provided along the downstream side of the wall of a dryer 10, in which the pulse combustor is incorporated. In the pulse combustor with the composition above, the stream of compressed air 26*b*′ which obtained heat while flowing the space 13 between the outer wall of the pulse combustor and the heat insulating cover 12 flows through the air pipe 17 to the spiral tube 60. The high temperature stream of compressed air 26*b*′ flowing in the spiral tube 60 thermally shields the inner wall of the dryer 10 from outside in order to maintain the temperature in the downstream area of the dryer 10, that is, the area where substance containing water contacts (in this embodiment, the inside of the part where the spiral tube 60 is provided). Further, in this pulse combustor, the stream of compressed air 26*b* lowers the temperature of the outer wall of the pulse combustor.

The pulse combustion method and the pulse combustor according to the present invention are not limited to the types which have been described above, and various changes and modifications are available. Especially with regard to shapes, the shapes of the combustion chamber 2, the air intake 3 and the exhaust pipe 4 are not limited to those which have been indicated in the above embodiments, and the pulse combustor 1 may be made into an arbitrary shape. Also, the pulse combustor shown in FIG. 2 may be provided with the space 13 as indicated in FIGS. 4 through 7.

I claim:

1. In a pulse combustion method using a pulse combustor comprising a combustion chamber, an air intake with an open end, and exhaust pipe which are arranged in line with the combustion chamber in the middle, a fuel port and an ignition means, the improvement is that said method comprises a step of pushing the sound wave energy and the combustion gas which flow toward the air intake back to the combustion chamber by jetting stream of compressed gas toward the open end of the air intake.

2. In a pulse combustor comprising a combustion chamber, an air intake with an open end, an exhaust pipe which are arranged in line with the combustion chamber in the middle, a fuel port and an ignition means, the improvement is that said combustor comprises a compressed gas supplying means disposed at a position opposing to the open end of the air intake so that a steam of compressed gas jetted from the compressed gas supplying means is blown into the combustion chamber through the open end of the air intake.

3. A pulse combustor as claimed in claim 2, wherein the compressed gas supplying means is disposed diagonally so that a stream of compressed gas jetted from the compressed gas supplying means is blown into the combustion chamber through the open end of the air intake at a specified angle.

4. A pulse combustor as claimed in claim 2, wherein the compressed gas supplying means is disposed in front of the open end of the air intake so that the open end of the air intake is covered with a stream of compressed gas jetted from the compressed gas supplying means completely.

5. In a pulse combustor comprising a combustion chamber, an air intake with an open end, an exhaust pipe which are arranged in line with the combustion chamber in the middle, a fuel port and an ignition means, the improvement is that said combustor comprises a compressed gas supplying means disposed at a position opposing to the open end of the air intake so that a stream of compressed gas jetted from the compressed gas supplying means is blown into the combustion chamber through the open end of the air intake, and a heat insulating cover enclosing the pulse combustor so as to form an annular space between them, in which the compressed gas supplying means is arranged so that a part of the stream of compressed gas jetted from the compressed gas supplying means is blown into one end of the space and is discharged from the downstream end of the space.

6. A pulse combustor as claimed in claim 5, wherein the downstream end of the space is open straight so that the compressed gas discharged from the space flows in the same direction as the combustion gas discharged through the exhaust pipe of the pulse combustor.

7. A pulse combustor as claimed in claim 5, wherein the downstream end of the space is provided with a baffleplate and a band-shaped gap is provided around the heat insulating cover so that the compressed gas discharged from the gap flows in a direction perpendicular to the axis of the exhaust pipe.

8. A pulse combustor as claimed in claim 5, wherein the downstream end of the space is closed and a nozzle slanting downward to the downstream direction is connected at the lower part of the downstream end of the space.

9. A pulse combustor as claimed in claim 5, wherein the downstream end of the space is closed and a pipe is connected to the downstream end of the space to lead to a spiral tube which is provided along the wall of a dryer, in which the combustor is incorporated.

* * * * *